US006011569A

United States Patent [19]

Pockett

[11] Patent Number: 6,011,569

[45] Date of Patent: Jan. 4, 2000

[54] METHOD AND APPARATUS FOR ELECTRONICALLY PRINTING ON A SUBSTRATE WITHOUT A CONDUCTIVE AROUND PLANE UTILIZING A DONOR ROLLER FOR APPLYING TONER

[75] Inventor: John David Pockett, Fitzroy, Australia

[73] Assignee: Dainippon Ink and Chemicals Inc., Tokyo, Japan

[21] Appl. No.: 08/811,533

[22] Filed: Mar. 4, 1997

[30] Foreign Application Priority Data

Mar. 5, 1996 [AU] Australia ..... PN8464

[51] Int. Cl.[7] ..... B41J 2/39; B41J 2/395; B41J 2/40

[52] U.S. Cl. ..... 347/151

[58] Field of Search ..... 347/112, 115, 347/120, 148, 151, 125; 399/305, 308, 310, 311, 312, 313, 320, 340, 135, 153, 174; 101/121, 114; 430/25, 45, 46, 57, 48, 60

[56] References Cited

U.S. PATENT DOCUMENTS

| | | | |
|---|---|---|---|
| 3,561,356 | 2/1971 | Rarey et al. | 101/129 |
| 4,023,894 | 5/1977 | Goel | 399/312 |
| 4,494,129 | 1/1985 | Gretchev | 347/127 |
| 4,514,078 | 4/1985 | Béduchaud et al. | 399/307 |
| 4,527,177 | 7/1985 | Day | 347/125 |
| 4,607,269 | 8/1986 | Playe | 347/148 |
| 4,783,716 | 11/1988 | Nagase et al. | 399/168 |
| 5,124,730 | 6/1992 | Lewicki, Jr. et al. | 347/154 |
| 5,157,423 | 10/1992 | Zur | 347/120 |
| 5,170,188 | 12/1992 | Bowers et al. | 347/123 |
| 5,187,501 | 2/1993 | Lewicki, Jr. et al. | 347/112 |
| 5,204,697 | 4/1993 | Schmidlin | 347/115 |
| 5,289,214 | 2/1994 | Zur | 347/120 |
| 5,434,651 | 7/1995 | Aizawa et al. | 399/174 |
| 5,587,264 | 12/1996 | Iijima et al. | 430/57 |
| 5,638,103 | 6/1997 | Obata et al. | 347/164 |
| 5,814,434 | 9/1998 | Nakamura et al. | 430/25 |

FOREIGN PATENT DOCUMENTS 2 095 625 10/1982 United Kingdom .

OTHER PUBLICATIONS

Japanese Abstract No. 03–078767, vol. 015, No. 247, Jun. 25, 1991.

Japanese Abstract No. 05–289452, vol. 018, No. 081, Feb. 9, 1994.

*Primary Examiner*—N. Le
*Assistant Examiner*—L. Anderson
*Attorney, Agent, or Firm*—Evenson, McKeown, Edwards & Lenahan, PLLC

[57] ABSTRACT

A method and apparatus for electronic printing onto a transparent, translucent or opaque substrate. The substrate is of a type which will support an electrostatic image on a surface thereof and which does not have a conductive ground plane affixed to or deposited on its rear surface. The method includes the steps of applying a selected charge pattern to the surface of the substrate to form an electrostatic latent image thereon, applying an electrostatic toner to the surface via a donor member to provide a toner image thereon and fixing the toner. The apparatus includes a charging arrangement to deposit a selected charge pattern onto a surface of the substrate, a donor member arrangement to transfer toner from a toner source to the surface of the substrate and a fixer arrangement to fix the toner to the surface of the substrate.

23 Claims, 2 Drawing Sheets

METHOD AND APPARATUS FOR ELECTRONICALLY PRINTING ON A SUBSTRATE WITHOUT A CONDUCTIVE AROUND PLANE UTILIZING A DONOR ROLLER FOR APPLYING TONER

FIELD OF THE INVENTION

This invention relates to electronic printing and more particularly to electronic printing on specialised substrates such as those suitable for use in display technology.

BACKGROUND OF THE INVENTION

Electronic printing where there is direct charge transfer onto the surface of a substrate has necessarily in the past been done by depositing charge on a dielectric substrate which has a fixed or deposited conductive ground plane or backing plate to the dielectric substrate. In the case of display technology which require back lighting where it is desirable to have a transparent substrate such a deposited conductive ground plane has had to be of a transparent nature. For instance with colour liquid crystal display screens for lap top computers which are backlit and hence cannot have an opaque conductor on the rear face it is desirable to have some other method of laying down the colour filter matrix on the substrate. There are many applications, however, where it is not cost effective, convenient or possible to have a conductive ground plane on this substrate for subsequent processing steps and final use of the product.

The prior art discloses several methods of laying down a charge pattern onto a dielectric. U.S. Pat. No. 5,124,730 assigned to Armstrong World Industries Inc discloses laying down a thin removable dielectric surface onto a conductive belt, laying down a charge pattern onto the conductive belt depositing and fixing a toner onto the dielectric layer and then removing the dielectric layer. There is no requirement in this patent that the dielectric layer be transparent as the invention is particularly adapted for printing onto thin vinyl sheets which are subsequently placed onto backings for vinyl floor tiles and wallpapers. The dielectric layer is extremely thin, being in the order of from 0.2 to 10 mils (5 to 250 microns) thick as it appears that thicker layers will not hold a charge during the laying down of the charge pattern and depositing the toner. Japanese Patent specification Publication No. 05-127015 in the name of Toyo Ink MFG Co Ltd uses electronic printing to form an optical colour filter matrix to be used in a colour television or liquid crystal display. To enable deposition of the optical colour filter there is formed a photoconductive layer onto the substrate and the image is formed onto the photoconductive layer by masking and light. This disclosure does not show direct laying down of a charge pattern onto the substrate but uses photoconductive and masking technology to lay down the charge pattern.

Japanese Patent specification Publication No. 03-150503 in the name of Toppan Printing Co Ltd uses a mask to define the charge pattern on the surface of a substrate with a conductor affixed to the rear surface of the substrate the conductor disclosed is an indium tin oxide transparent conductor. As discussed above this is unacceptable for some applications.

The problem to be addressed by the present invention is that where there is not an integral ground plane on the substrate decay of the charge pattern laid down on the surface of the substrate can easily occur and the electrostatic latent image is easily perturbed by the presence of a charged toner during the toner development step. This can lead to loss of resolution and/or displacement of toner particles. Particularly when three colour printing is done this problem is of serious concern.

It is the object of this invention to provide a method of formation and development of an electrostatic image on a dielectric substrate which does not intrinsically distort, discharge or pertubate the electric field emanating from the dielectric substrate.

The present invention has particularly application within the display industry and in particular the electronic display industry for instance with respect to liquid crystal displays. In one embodiment the invention allows direct imaging on so-called black matrix glass such that the colour filters can be directly formed on such glass by way of electrostatic attraction of the pigments and associated binder resins without the need to coat the glass with a conductive layer on the opposite side of the glass.

The invention is not limited to this application, however, but is applicable to any system where toner is to be laid down onto a dielectric substrate which does not or cannot include a conductive ground plane.

BRIEF SUMMARY OF THE INVENTION

In one form the invention is said to reside in a method of electronic printing onto a substrate, the substrate being opaque, transparent or translucent and adapted to support an electrostatic image on a surface thereof and not including a conductive ground plane affixed to or deposited on a rear surface thereof, the method including the steps of applying a selected charge pattern to the surface of the substrate to form an electrostatic latent image thereon and applying an electrostatic toner to the latent image by means of a donor member to provide a toner image thereon.

In an alternative form the invention is said to reside in a method of electronic printing onto a substrate, the substrate being opaque, transparent or translucent and adapted to support an electrostatic image on a surface thereof and not including a conductive ground plane affixed to or deposited on a rear surface thereof, the method including the steps of applying a selected charge pattern to the surface of the substrate to form an electrostatic latent image thereon, applying an electrostatic toner to the surface by means of a donor member to provide a toner image thereon and fixing the toner.

In an alternative form the invention may be said to reside in an electronic printing apparatus adapted for printing onto an opaque, transparent or translucent substrate of a type having a surface adapted to support an electrostatic image, the substrate being of a type without a fixed or deposited conductive ground plane, the apparatus comprising means to deposit a selected charge pattern onto a surface of the substrate and a donor member arrangement to transfer toner from a toner source to the surface of the substrate and fixing means to fix the toner to the surface of the substrate.

The dielectric substrate according to this invention may be selected from glass, acrylic, polycarbonate, polyurethane, polyvinyl chloride, polyester, quartz or sapphire. The substrate may be rigid or flexible. The thickness of the substrate may be any convenient thickness for a final application and preferably is in the range of from 5 to 2500 microns thick.

The substrate may be passed through the apparatus as individual pieces as in the case for instance of screens for LCD displays or maybe passed through as a continuous sheet and cut into the required size after processing.

To assist with the transfer of toner from the donor member to the front face of the substrate there may be provided a ground plane behind the substrate and advantageously the substrate is held on the ground plane during the processing steps. Such holding may be by means of a vacuum system or the like.

There may be further provided means to apply an even charge pattern to the front face of the substrate to provide an evenly charged surface on the substrate of opposite polarity to that of the charge pattern deposit on the substrate so that toner does not deposit onto unwanted portions of the substrate. Such an even charge pattern may be provided by means of a corona discharge arrangement.

The charge pattern applied to the front face of the substrate may be deposited by ion or electron deposition techniques or corona discharge techniques.

Ion deposition techniques are disclosed in U.S. Pat. No. 4,494,129 in the name of Delphax Systems and U.S. Pat. No. 5,170,188 assigned to Armstrong World Industries Inc. the teaching of which are incorporated herein by reference.

The corona discharge arrangement can be by the system disclosed in U.S. Pat. No. 5,157,423 in the name of Cubital Ltd the teaching of which are incorporated herein by reference.

The donor member may be of a roller type.

The toner may be a liquid or a powder type of toner. The liquid toner may be of a pigmented type, a dyestuff type or a combination thereof.

There may be three specific systems of the general arrangement discussed above for the method and apparatus of the present invention for applying an electrostatic image to the substrate.

A first method is a direct imaging system where the charge pattern is applied directly to the substrate and toner is then applied by means of the donor member.

A second system may use a transfer roller so that the image is formed onto a dielectric surface of a transfer roller and then transferred to the substrate before fixing.

A third system uses a charge transfer roller in a system known as transfer of electrostatic images where the electrostatic image is formed on a dielectric on a transfer roller and the electrostatic image is transferred to the substrate which is then developed by means of a toner from a donor electrode before fixing.

The fixing of the toner onto the substrate may be by a range of methods depending upon the type of toner used and the subsequent processing steps required for the substrate.

A first system may use a self fixing system where merely by evaporation of a carrier occurs to fix the toner to the substrate.

A second form of fixing may be by one or another form of radiation. The radiation may be heat, laser, ultraviolet or electron beam radiation to cure a monomer to a polymer in the carrier.

A third method of fixing may be by means of chemical fixing where the developed image is fixed by means of chemical fixing where the deposited toner is for instance contacted with a chemical vapour which completes a polymerisation reaction with resins in the carrier. In the formation of colour filters for LCD displays chemical fixing is preferred because it can provide an even coating of colour in each colour pixel.

An alternative fixing system may be by means of a solvent vapour system in which a solvent vapour dissolves and coalesces polymer particles of the toner to fix the toner image There may be further provided heating of the substrate before the various processing steps. In the case of a glass substrate for instance this ensures that there is a dry surface upon which the imaging takes place. This ensures that the surface resistivity of the substrate is increased thereby preventing loss of charge during imaging.

Preferably the developed image is fixed before removal from the ground plane.

It will be seen that a particular advantage of the present invention is that a substrate does not need pre-treatment before the imaging steps.

This then generally describes the invention but to assist with understanding reference will now be made to the accompanying drawings in which:

DETAILED DESCRIPTION OF THE DRAWINGS

Figure 1:
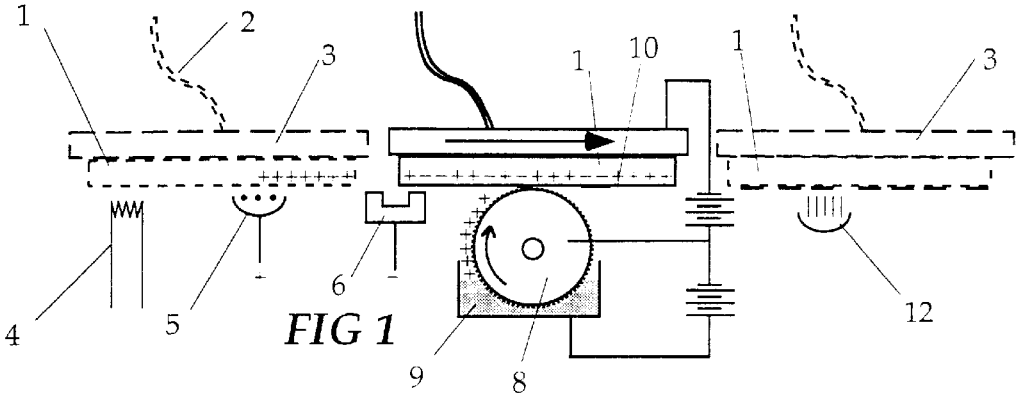
FIG. 1 shows a schematic view of a first embodiment of an electronic printing apparatus according to this invention.

Now looking closely at the drawings and in particular FIG. 1 it will be seen that there is shown three stages in electronic printing onto a substrate. In a first stage the substrate 1 which is held by a vacuum applied by means of vacuum tube 2 against a ground plane backing plate 3 is heated by means of heater 4 and has applied to it an even charge by means of a corona discharge arrangement 5. In this embodiment an even positive charge is applied to the lower face of the substrate 1. As the substrate 1 moves to the right as shown in FIG. 1 an ion discharge arrangement 6 applies negative ions to the substrate surface in a selected pattern such that in some positions the positive charge on the surface is transferred to a negative charge. The substrate 1 then passes over a donor roller 8 which extends from a toner tank 9 and carries toner up to the substrate 1. The toner is of a positively charged type and where there are negative charges on the substrate toner 10 is deposited. The substrate 1 and ground plane or backing plate 3 then travel to the fixing station 12 where the toner is fixed to provide the image on the face of the substrate. There is a potential difference bias 13 between the donor bath 9 with respect to the donor roller 8 and a potential difference bias 14 between the donor roller 8 with respect to the ground plane or backing plate 3.

The apparatus of this embodiment of the invention may be operated with the following range of settings:

The AC corona frequency 10 Hz to 100 KHz

The AC corona voltage 3 to 10 kV RMS.

The corona bias electrode −100V to 900V

The gap between the corona bias electrode and the substrate 0.1 to 5 mm.

The donor roller bias −800V to 800V with respect to the ground plane or backing plate.

The donor bath bias −40V to 1000V with respect to the donor roller.

The donor roller speed −500 to 500 RPM

The substrate moved at a speed of 0.1 to 5000 mm/sec.

The gap between the ion discharge electrode and the substrate in the range of 100 to 1000 μm The gap between the donor roller and the substrate between 50 to 500 μm.

In one particular embodiment of the invention according to FIG. 1 the AC corona is run at a frequency of 50 Hz and a voltage of 5 kV RMS. The corona bias electrode is set at 500V and the gap between the corona bias electrode and the substrate is 3 mm. The donor roller has a bias of 0V with respect to the backing plate and the donor bath has a bias of 250V with respect to the donor roller. In a preferred embodiment the donor roller has a speed of 30 RPM and the substrate is moved at a speed of 46 mm/sec. In this embodiment the gap between the ion discharge electrode 6 and the substrate 1 may be in the range of 300 to 350 μm and the gap between the donor roller 8 and the substrate 1 may be between 175 and 225 μm. The thickness of the substrate was 1.3 mm.

Figure 2:
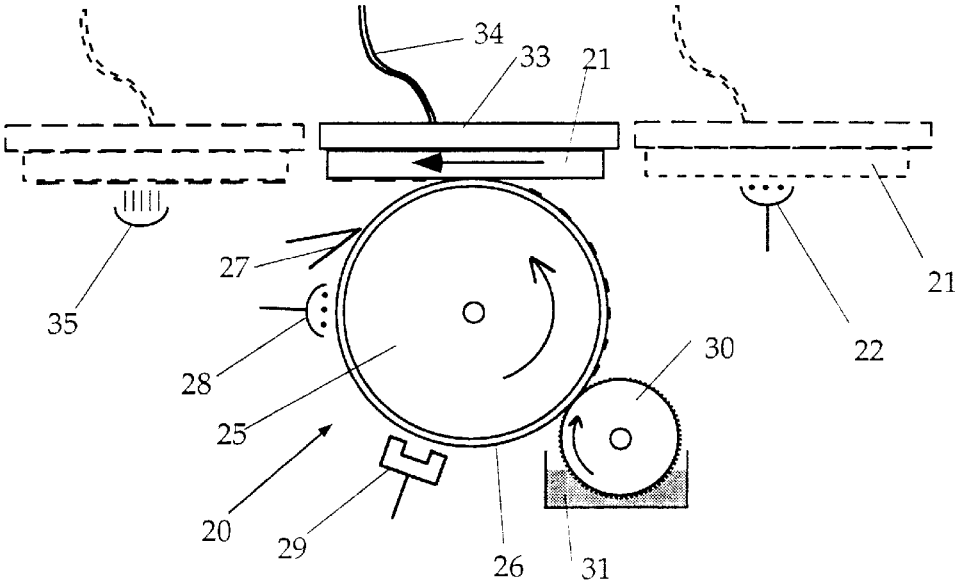
FIG. 2 shows a schematic view of a second embodiment of an electronic printing process according to this invention.

FIG. 2 shows an arrangement where there is a transfer roller 20 used. In this embodiment the substrate 21 is first charged with an even charge by means of corona discharge arrangement 22 and is then moved to the transfer roller. The transfer roller comprises a conductive body 25 and a dielectric outer layer 26. Scraper 27 cleans the dielectric surface before a corona discharge arrangement 28 provides an even charge onto the dielectric surface 26 of the transfer roller 20. The transfer roller is then moved next to an ion discharge electrode 29 which places a charge pattern onto the dielectric surface. A donor roller 30 then transfers toner from toner reservoir 31 to develop those portions of the image with a selected charge and then the transfer roller is turned to a position where it transfers the toner to the substrate 21 with a suitable bias voltage between the backing plate 33 and the transfer roller 20.

The substrate 21 is held against the backing plate 33 by means of a vacuum applied through vacuum tube 34.

The substrate and backing plate are then moved to a fixing station where fixer arrangement 35 fixes the toner onto the substrate surface.

Figure 3:
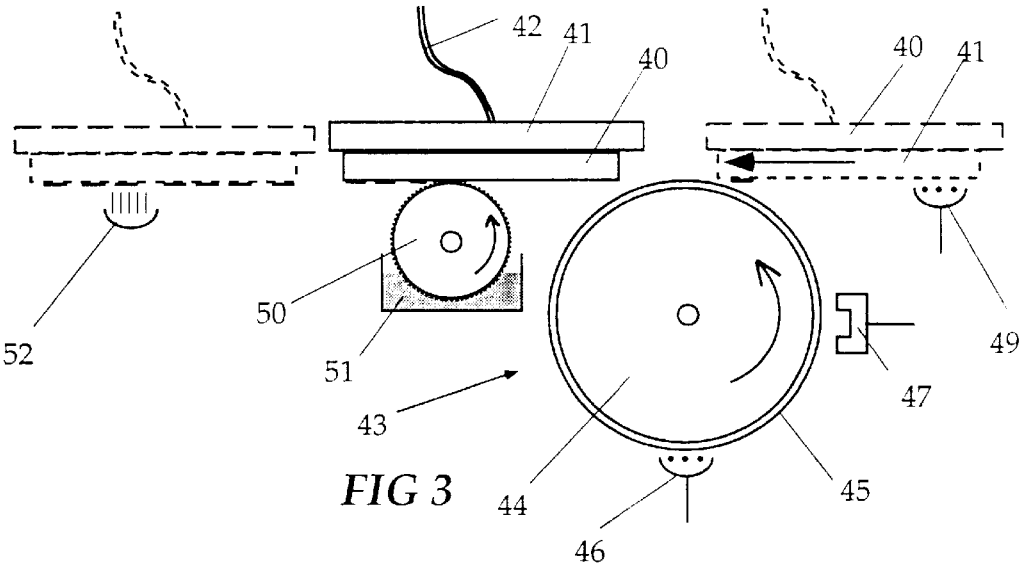
FIG. 3 shows a schematic view of a further embodiment of an electronic printing process according to this invention.

The embodiment shown in FIG. 3 uses transfer of electrostatic images to charge the substrate 40. The substrate 40 is held against backing plate 41 by means of a vacuum applied by means of vacuum tube 42. Charge transfer roller 43 has a conductive body 44 and a dielectric surface layer 45. A corona discharge arrangement 46 applies an even charge to the dielectric surface 45 of the charge transfer roller 43 and then the ion deposition electrode 47 applies a charge pattern to the surface of the dielectric 45.

At the same time the substrate front face may have an even charge pattern applied to it by means of corona discharge arrangement 49 and then the substrate and its backing plate are moved over the charge transfer roller whereby means of a suitable impressed voltage charge is transferred to the substrate. Subsequently a donor roller 50 applies toner 51 to the charged portions of the substrate 40 again with a suitable selected bias voltage and then these are moved to a fixing station 52.

Figure 4:
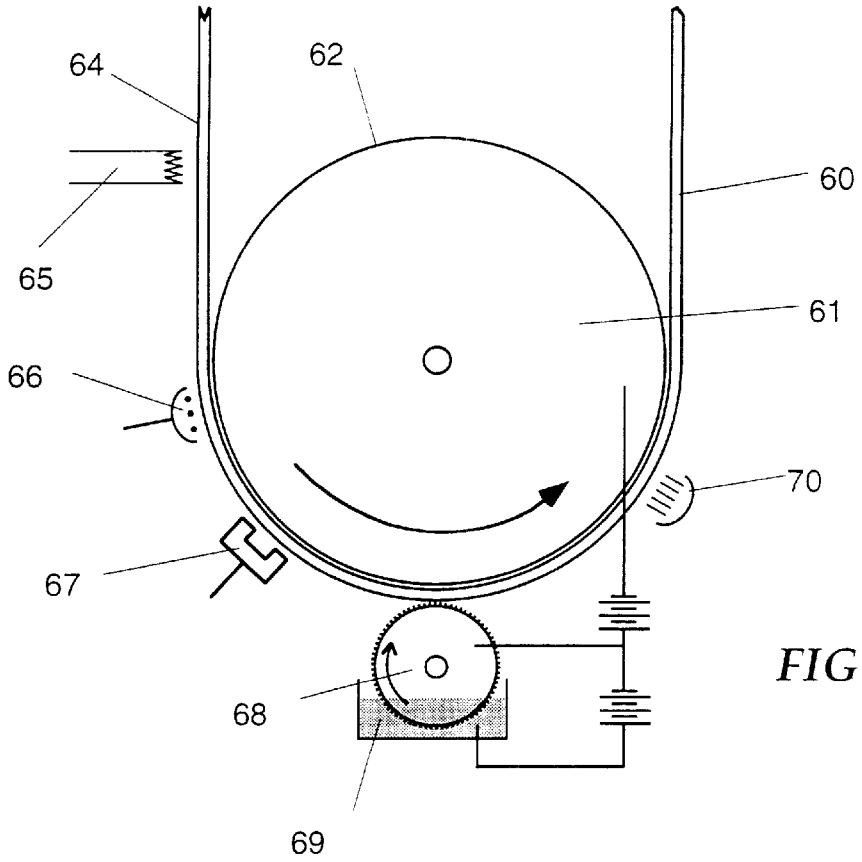
FIG. 4 shows a schematic view of a still further embodiment of an electronic printing process according to this invention.

FIG. 4 shows an embodiment in which the printing is done onto a flexible substrate. The flexible substrate 60 passes over a drum or roller 61. The flexible substrate is not restricted in thickness except in as far as it must be sufficiently flexible to pass around the drum or roller 61 of the printing stage. For instance the flexible substrate may be from 5 to 2500 microns thick. The drum 61 has a conductive surface 62 which forms the ground plane for the substrate during the charging and toning of the surface of the substrate. In the process of printing on the substrate the surface 64 is first dried by means of heater 65 and then a corona discharge 66 deposits an even charge pattern onto the surface 64. A printing head 67 comprising an electron deposition device deposits a selected charge pattern onto the surface 64. The selected charge pattern is toned by the donor roller 68 taking toner from a toner bath 69 in the same manner as described with reference to FIG. 1. The toned surface is then fixed in a fixing station 70.

Figure 5:
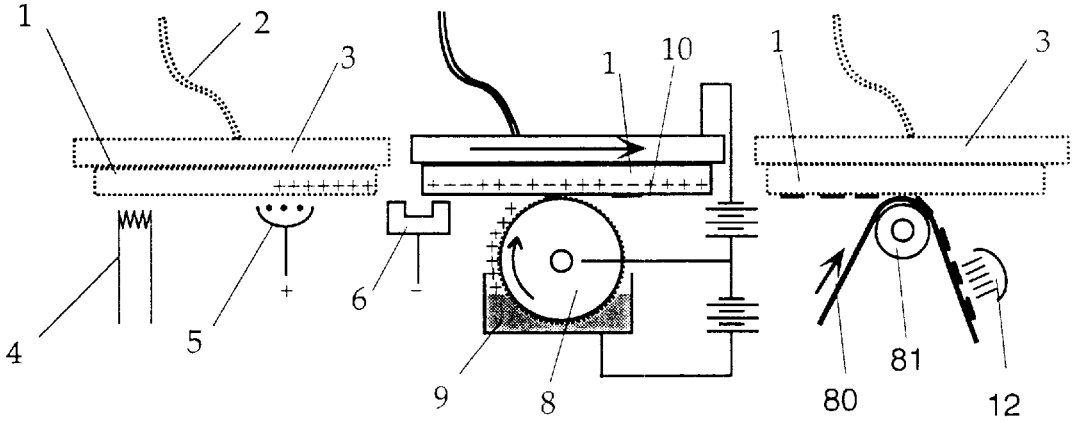
FIG. 5 shows a third embodiment of an electronic printing process onto transparent substrates according to this invention.

FIG. 5 shows an embodiment in which the printing is done by means of an intermediate transfer stage before deposition onto a substrate. The process is substantially the same as that as disclosed in FIG. 1 with the same reference numerals used for the same items. Before the fixing stage the toner image is transferred onto a flexible final substrate 80 by contact between the substrate 80 and the intermediate substrate 1 as it passes over a roller 81. Fixing station 12 then fixes the toner image on the final substrate.

It will be seen that by this invention there is provided a method and apparatus by which a surface of a transparent, translucent or opaque substrate may be printed by means of electronic printing techniques. The invention is particularly applicable for the printing of colour filters for small displays of high resolution.

Throughout this specification and the claims that follow unless the context requires otherwise, the words 'comprise' and 'include' and variations such as 'comprising' and 'including' will be understood to imply the inclusion of a stated integer or group of integers but not the exclusion of any other integer or group of integers.

I claim:

1. A method of electronic printing onto a glass substrate, the substrate having a front surface and a rear surface and not including a conductive ground plane affixed to or deposited on the rear surface thereof, the method comprising the acts of:

arranging a ground plane behind the glass substrate and holding the glass substrate to the ground plane during subsequent processing steps, wherein the glass substrate is held to the ground plane by a vacuum system;

applying an even charge to the front surface of the glass substrate to provide an even surface charge of a selected polarity on the glass substrate;

applying a selected charge pattern to the front surface of the glass substrate of a polarity opposite to that of the even surface charge to form an electrostatic latent image thereon;

transporting a liquid electrostatic toner from a toner source to the electrostatic latent image on a donor roller;

applying the electrostatic toner to the electrostatic latent image via the donor roller to provide a toner image on the glass substrate;

fixing the toner image on the glass substrate at a fixing station; and releasing the glass substrate from the ground plane.

2. A method of electronic printing as in claim 1 wherein the act of applying an even charge is effected by a corona discharge arrangement.

3. A method of electronic printing as in claim 2 further comprising the act of applying a voltage of from 3 to 10 kV RMS to the corona discharge arrangement.

4. A method of electronic printing as in claim 2 further comprising the act of forming a gap between the corona discharge arrangement and the glass substrate of from 0.1 to 5 mm.

5. A method of electronic printing as in claim 1 wherein the act of applying a selected charge pattern to the front surface of the glass substrate is effected by an ion discharge device.

6. A method of electronic printing as in claim 5 further comprising the act of forming a gap between the ion discharge device and the glass substrate of from 100 to 1000 μm.

7. A method of electronic printing as in claim 1 further comprising the act of applying a bias voltage to the donor roller.

8. A method of electronic printing as in claim 7 wherein the bias voltage is in the range of from −800 volts to 800 volts with respect to the ground plane.

9. A method of electronic printing as in claim 1 further comprising the act of applying an electrical potential bias to the toner source with respect to the donor roller of from −40 volts to 1000 volts.

10. A method of electronic printing as in claim 1 further comprising the act of selecting the liquid toner from a group consisting of a pigmented type, a dyestuff type or a combination of the pigmented type and the dyestuff type.

11. A method of electronic printing as in claim 1 wherein the fixing act comprises fixing the toner image by heat.

12. A method of electronic printing as in claim 1 further comprising the act of pre-heating the glass substrate to obtain a dry surface before application of the even charge.

13. An electronic printing apparatus adapted for printing onto a glass substrate, the substrate being of a type having a front surface adapted to support an electrostatic image and without a fixed or deposited conductive ground plane on a rear surface thereof, the apparatus comprising:

a ground plane provided behind the glass substrate;

a vacuum holding system to hold the glass substrate to the ground plane;

a first charge deposition device to first deposit an even charge to the front surface of the substrate to provide an even charge of opposite polarity to that of a selected charge pattern subsequently deposited on the front surface of the substrate;

a second charge deposition device to deposit the selected charge pattern onto the front surface of the substrate to provide an electrostatic latent image thereon;

a donor roller arrangement to transfer liquid toner from a toner source to the front surface of the substrate to develop the electrostatic latent image to provide a toned image; and a fixing device to fix the toned image to the front surface of the glass substrate.

14. An electronic printing apparatus as in claim 13 wherein the first charge deposition device is a corona discharge arrangement.

15. An electronic printing apparatus as in claim 14 wherein the corona discharge arrangement is operated at a voltage of from 3 to 10 kV RMS.

16. An electronic printing apparatus as in claim 14, further comprising a gap arranged between the corona discharge arrangement and the substrate of from 0.1 to 5 mm.

17. An electronic printing apparatus as in claim 13, wherein the second charge deposition device is an ion discharge device.

18. An electronic printing apparatus as in claim 17, further comprising a gap arranged between the ion discharge device and the substrate of from 100 to 1000 μm.

19. An electronic printing apparatus as in claim 13, wherein a bias voltage is applied to the donor roller in the range of from −800 volts to 800 volts with respect to the ground plane.

20. An electronic printing apparatus as in claim 13, wherein an electrical potential bias is applied to the toner source with respect to the donor roller of from −40 volts to 1000 volts.

21. An electronic printing apparatus as in claim 13, wherein the liquid toner is selected from the group consisting of a pigmented type, a dyestuff type, and a combination of the pigmented type and the dyestuff type.

22. An electronic printing apparatus as in claim 13, wherein the fixing device is a heat fixing system.

23. An electronic printing apparatus as in claim 13 further comprising a heater for pre-heating the glass substrate to obtain a dry surface before operating the first charge deposition device.

* * * * *

UNITED STATES PATENT AND TRADEMARK OFFICE

CERTIFICATE OF CORRECTION

PATENT NO. : 6,011,569

DATED : January 4, 2000

INVENTOR(S) : Pockett

It is certified that error appears in the above-identified patent and that said Letters Patent is hereby corrected as shown below:

On the Title page, item [73], please change the Assignee from "Dainippon Ink and Chemicals Ink., Tokyo, Japan" to --Dainippon Ink and Chemicals Inc., Tokyo, Japan and Research Laboratories of Australia Pty Ltd., Eastwood, Australia--.

Signed and Sealed this

Thirty-first Day of October, 2000

*Attest:*

*Attesting Officer*

Q. TODD DICKINSON

*Director of Patents and Trademarks*